US011326426B2

(12) United States Patent
Howell et al.

(10) Patent No.: US 11,326,426 B2
(45) Date of Patent: May 10, 2022

(54) HYDROCARBON WELLS INCLUDING GAS LIFT VALVES AND METHODS OF PROVIDING GAS LIFT IN A HYDROCARBON WELL

(71) Applicant: ExxonMobil Upstream Research Company, Spring, TX (US)

(72) Inventors: David A. Howell, Houston, TX (US); Rosmer Maria Brito Jurado, Spring, TX (US); Federico G. Gallo, Houston, TX (US); Michael C. Romer, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 29 days.

(21) Appl. No.: 16/863,873

(22) Filed: Apr. 30, 2020

(65) Prior Publication Data

US 2020/0378223 A1 Dec. 3, 2020

Related U.S. Application Data

(60) Provisional application No. 62/853,915, filed on May 29, 2019.

(51) Int. Cl.

| | |
|---|---|
| ***E21B 43/12*** | (2006.01) |
| ***E21B 34/10*** | (2006.01) |
| ***E21B 34/08*** | (2006.01) |

(52) U.S. Cl.

CPC ..... *E21B 43/123* (2013.01); *E21B 34/08* (2013.01); *E21B 34/10* (2013.01); *E21B 43/13* (2020.05)

(58) Field of Classification Search

CPC ..... E21B 34/08; E21B 34/085; E21B 43/122; E21B 43/13; E21B 43/123

See application file for complete search history.

(56) References Cited

U.S. PATENT DOCUMENTS 5,353,237 A * 10/1994 Bass ..... G05D 21/02 700/272

6,328,102 B1 12/2001 Dean (Continued)

FOREIGN PATENT DOCUMENTS

| | | |
|---|---|---|
| EP | 2077374 A1 | 7/2009 |
| GB | 2393747 A | 4/2004 |

(Continued)

*Primary Examiner* — Cathleen R Hutchins

(74) *Attorney, Agent, or Firm* — ExxonMobil Upstream Research Company—Law Department

(57) ABSTRACT

Hydrocarbon wells including gas lift valves and methods of providing gas lift in a hydrocarbon well. The hydrocarbon wells include a wellbore extending within a subsurface region and a downhole tubular extending within the wellbore. The downhole tubular defines a tubular conduit, and the wellbore and the downhole tubular define an annular space therebetween. The hydrocarbon wells also include a lift gas supply system configured to provide a lift gas stream to the annular space and a closure material supply system configured to provide a closure material stream to the annular space. The hydrocarbon wells further includes a gas lift valve operatively attached to the downhole tubular. The gas lift valve includes a lift gas injection conduit and an actuation mechanism. The actuation mechanism selectively transitions to a closed state responsive to contact with the closure material. The methods include methods of operating the hydrocarbon wells.

18 Claims, 4 Drawing Sheets

(56) References Cited

U.S. PATENT DOCUMENTS

| | | | | |
|---|---|---|---|---|
| 7,111,675 | B2 | 9/2006 | Zisk, Jr. | |
| 7,322,803 | B2 | 1/2008 | Vogeley | |
| 7,484,940 | B2 | 2/2009 | O'Niell | |
| 7,597,150 | B2 | 10/2009 | Clem | |
| 8,133,041 | B2 | 3/2012 | Ludlow et al. | |
| 8,511,390 | B2 | 8/2013 | Coyle et al. | |
| 2002/0197174 | A1 | 12/2002 | Howard | |
| 2003/0010491 | A1 | 1/2003 | Collette | |
| 2006/0198742 | A1 | 9/2006 | DiFoggio et al. | |
| 2007/0181312 | A1* | 8/2007 | Kritzler | E21B 43/123 166/372 |
| 2007/0246225 | A1* | 10/2007 | Hailey, Jr. | E21B 34/00 166/386 |
| 2008/0080991 | A1 | 4/2008 | Yuratich et al. | |
| 2008/0283238 | A1* | 11/2008 | Richards | E21B 43/12 166/228 |
| 2009/0183879 | A1 | 7/2009 | Cox | |
| 2009/0218091 | A1 | 9/2009 | Dotson | |
| 2010/0012313 | A1 | 1/2010 | Longfield | |
| 2012/0023606 | A1 | 10/2012 | Bouldin et al. | |
| 2013/0056221 | A1* | 3/2013 | Johannessen | E21B 33/1208 166/373 |

FOREIGN PATENT DOCUMENTS

| | | | | |
|---|---|---|---|---|
| GB | 2403752 | A | 1/2005 | |
| GB | 2448069 | * | 1/2008 | E21B 33/00 |
| WO | 01/20126 | A2 | 3/2001 | |
| WO | 2009/077714 | | 6/2009 | |
| WO | 2011/079218 | A2 | 6/2011 | |

* cited by examiner

HYDROCARBON WELLS INCLUDING GAS LIFT VALVES AND METHODS OF PROVIDING GAS LIFT IN A HYDROCARBON WELL

CROSS-REFERENCE TO RELATED APPLICATION

This application claims the benefit of U.S. Provisional Application 62/853,915 filed May 29, 2019 entitled HYDROCARBON WELLS INCLUDING GAS LIFT VALVES AND METHODS OF PROVIDING GAS LIFT IN A HYDROCARBON WELL, the entirety of which is incorporated by reference herein.

FIELD OF THE DISCLOSURE

The present disclosure relates generally to hydrocarbon wells including gas lift valves and/or to methods of providing gas lift in a hydrocarbon well.

BACKGROUND OF THE DISCLOSURE

Conventional gas lift valves (GLVs) open and/or close responsive to a pressure differential thereacross. While conventional GLVs are effective in certain circumstances, they suffer from several significant limitations. As an example, it often is difficult to determine which conventional GLVs within a given hydrocarbon well are open vs. closed. As another example, conventional GLVs are calibrated prior to installation within the hydrocarbon well, and it is costly and time-consuming to recalibrate, repair, and/or replace conventional GLVs that are not operating as desired. As yet another example, conventional GLVs may leak and/or may open at unexpected, or undesired, times. In many instances, a conventional GLV is utilized for gas lift only once, and it may be beneficial to permanently close the conventional GLV after it is utilized, such as to avoid a potential for leakage therethrough. However, this is not feasible with conventional GLVs. Thus, there exists a need for improved hydrocarbon wells including gas lift valves and/or for methods of providing gas lift in the hydrocarbon wells.

SUMMARY OF THE DISCLOSURE

Hydrocarbon wells including gas lift valves and methods of providing gas lift in a hydrocarbon well. The hydrocarbon wells include a wellbore extending within a subsurface region and a downhole tubular extending within the wellbore. The downhole tubular defines a tubular conduit, and the wellbore and the downhole tubular define an annular space therebetween. The hydrocarbon wells also include a lift gas supply system configured to provide a lift gas stream to the annular space and a closure material supply system configured to provide a closure material stream to the annular space. The hydrocarbon wells further includes a gas lift valve operatively attached to the downhole tubular. The gas lift valve includes a lift gas injection conduit and an actuation mechanism. The lift gas injection conduit extends between the annular space and the tubular conduit. The actuation mechanism is configured to selectively transition between an open state, in which the gas lift valve permits fluid flow between the annular space and the tubular conduit via the lift gas injection conduit, and a closed state, in which the gas lift valve restricts fluid flow between the annular space and the tubular conduit via the lift gas injection conduit. Flow of the lift gas stream within the annular space provides a motive force for flow of the closure material to the gas lift valve, and the actuation mechanism is configured to transition from the open state to the closed state responsive to contact with the closure material.

The methods include providing a lift gas stream that includes a lift gas to an annular space. The annular space is defined between a downhole tubular and a wellbore of the hydrocarbon well. The downhole tubular extends within the wellbore and defines a tubular conduit. The methods also include providing a closure material stream that includes a closure material to the annular space and flowing the closure material stream through a lift gas injection conduit of a gas lift valve that is positioned along a length of the downhole tubular. Responsive to flow of the closure material stream through the lift gas injection conduit, the methods further include transitioning an actuation mechanism of the gas lift valve from an open state, in which the gas lift valve permits fluid flow between the annular space and the tubular conduit via the lift gas injection conduit, to a closed state, in which the gas lift valve restricts fluid flow between the annular space and the tubular conduit via the lift gas injection conduit.

DETAILED DESCRIPTION AND BEST MODE OF THE DISCLOSURE

Figure 1:
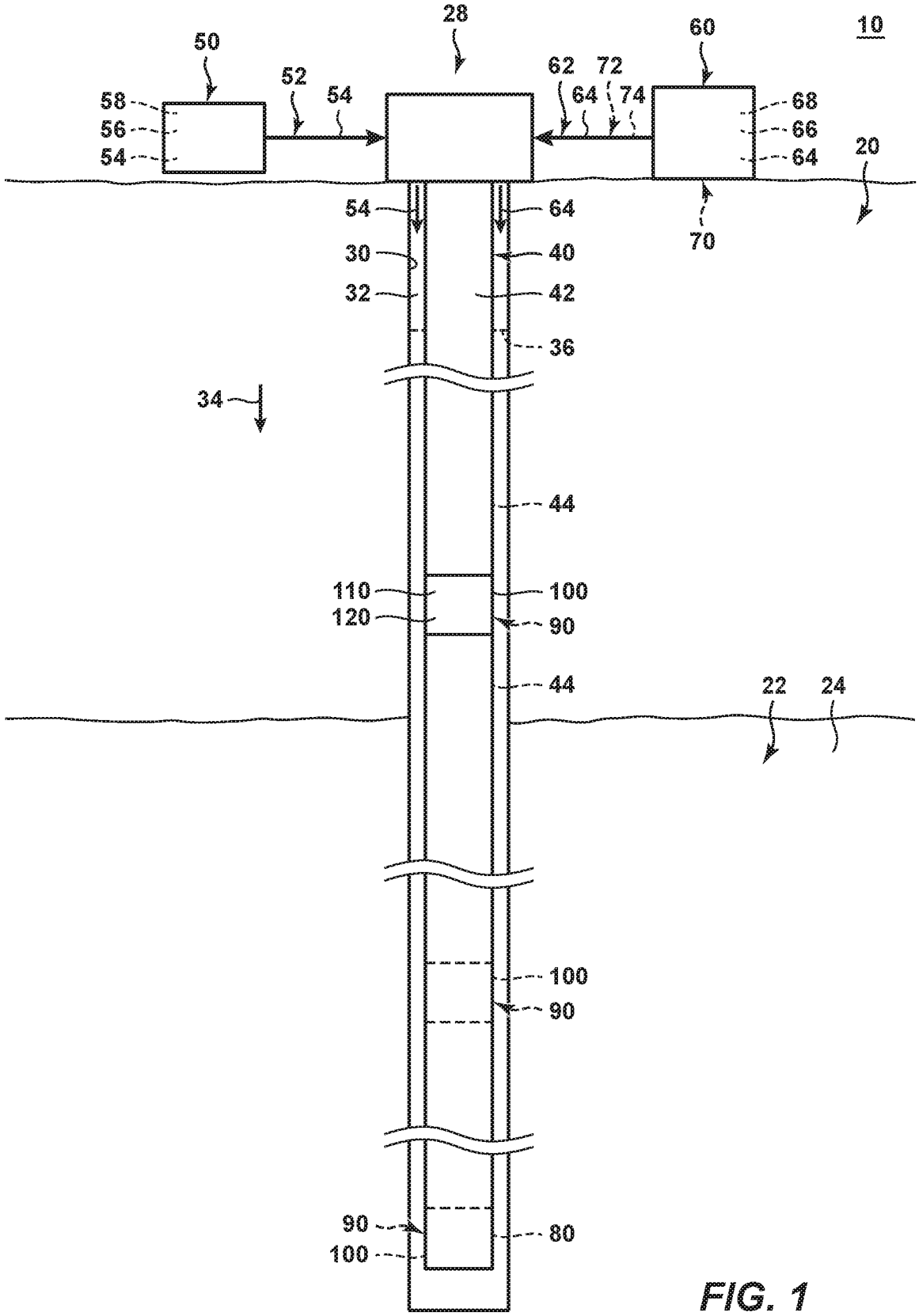
FIG. 1 is a schematic illustration of examples of a hydrocarbon well that may include a gas lift valve, according to the present disclosure.

FIGS. 1-4 provide examples of hydrocarbon wells 28, of gas lift valves 100, and/or of methods 200, according to the present disclosure. Elements that serve a similar, or at least substantially similar, purpose are labeled with like numbers in each of FIGS. 1-4, and these elements may not be discussed in detail herein with reference to each of FIGS. 1-4. Similarly, all elements may not be labeled in each of FIGS. 1-4, but reference numerals associated therewith may be utilized herein for consistency. Elements, components, and/or features that are discussed herein with reference to one or more of FIGS. 1-4 may be included in and/or utilized with any of FIGS. 1-4 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic illustration of a hydrocarbon well 28 according to the present disclosure. Hydrocarbon wells 28 include a wellbore 30 that extends within a subsurface region 20. Wellbore 30 also may be referred to herein as extending within a subterranean formation 22, which may include hydrocarbon fluids 24, and/or as extending between a surface region 10 and the subterranean formation.

Hydrocarbon well 28 also includes a downhole tubular 40 that extends within wellbore 30. Downhole tubular 40 forms, defines, and/or at least partially bounds a tubular conduit 42, and wellbore 30 and downhole tubular 40 define an annular space 32 therebetween.

Hydrocarbon well 28 further includes a lift gas supply system 50, a closure material supply system 60, and at least one gas lift valve 100. Lift gas supply system 50 is configured to provide a lift gas stream 52 that includes lift gas 54 to annular space 32. Closure material supply system 60 is configured to provide a closure material stream 62 that includes closure material 64 to the annular space.

Gas lift valve 100 is operatively attached to, forms a portion of, and/or at least partially defines downhole tubular 40. In some examples, gas lift valve 100 may be operatively attached to a mandrel 90 that may at least partially define downhole tubular 40 and/or that may operatively attach tubing segments 44 of the downhole tubular. In other examples, gas lift valve 100 may include and/or be a bottom hole valve 80 of the hydrocarbon well.

Figure 2:
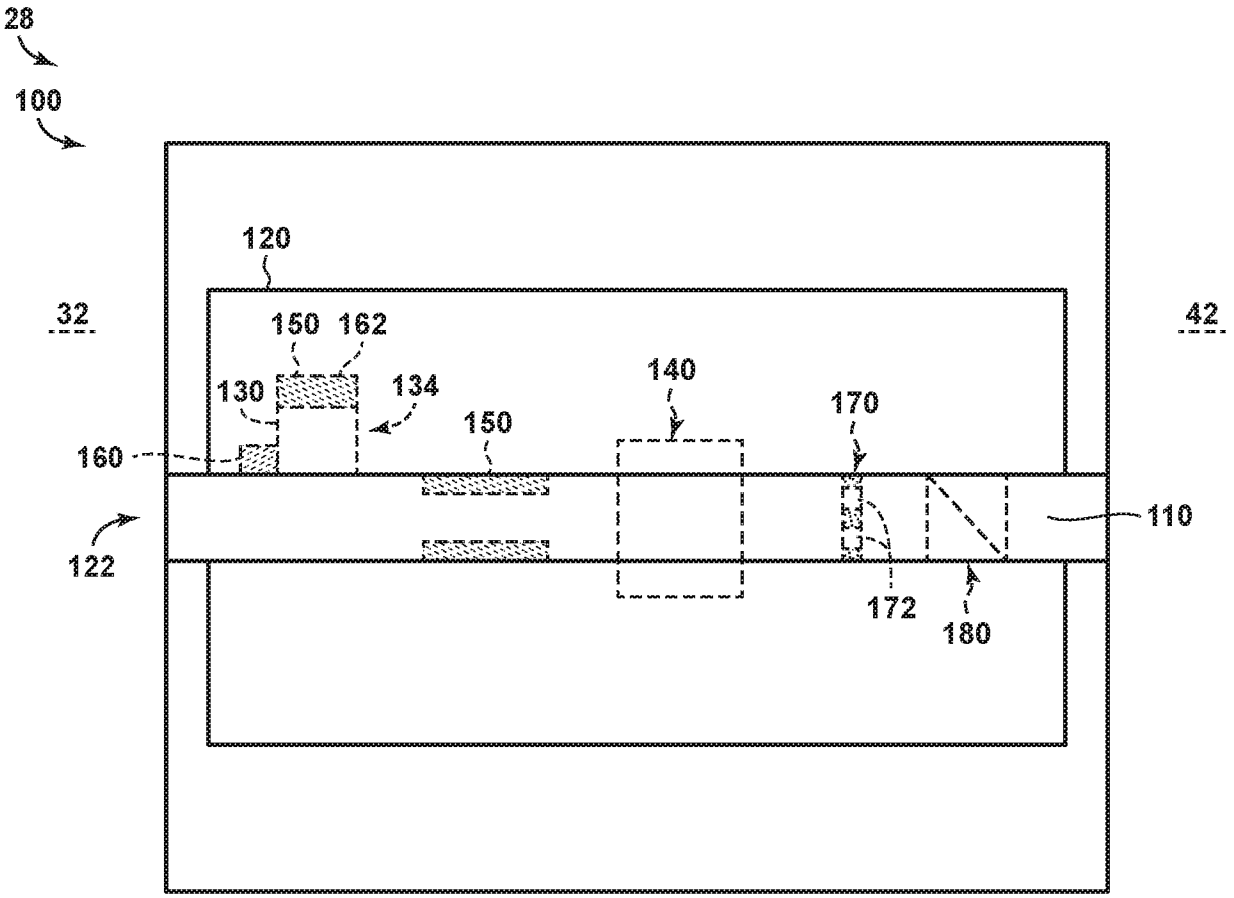
FIG. 2 is a schematic illustration of examples of a gas lift valve in an open state, according to the present disclosure.
Figure 3:
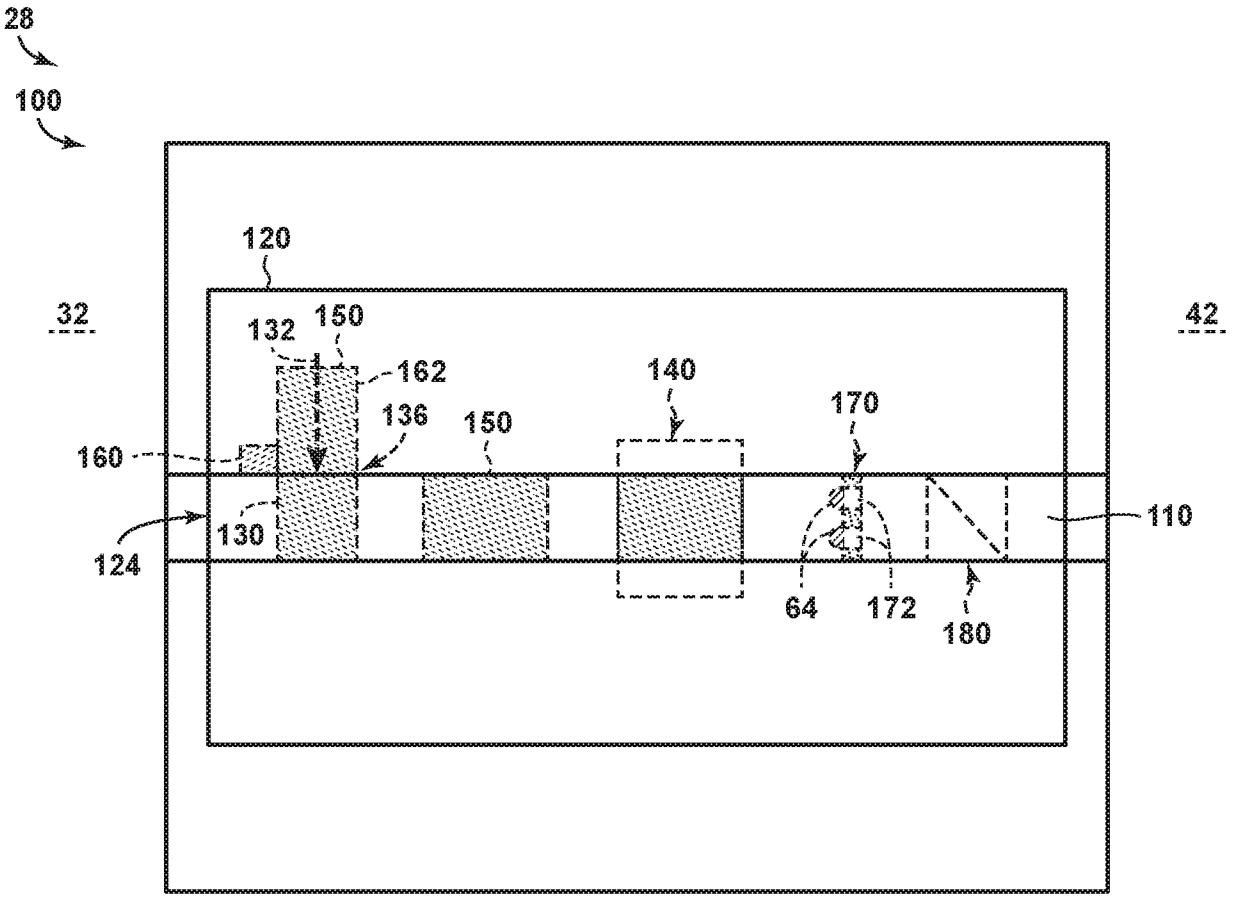
FIG. 3 is a schematic illustration of examples of a gas lift valve in a closed state, according to the present disclosure.

Gas lift valve 100 includes a lift gas injection conduit 110 and an actuation mechanism 120. Lift gas injection conduit 110 extends between annular space 32 and tubular conduit 42, such as to permit and/or to facilitate fluid communication between the annular space and the tubular conduit. Actuation mechanism 120 is configured to selectively transition between an open state 122, as schematically illustrated in FIG. 2, and a closed state 124, as schematically illustrated in FIG. 3. When the actuation mechanism is in the open state, gas lift valve 100 permits fluid flow between the annular space and the tubular conduit via the lift gas injection conduit. When the actuation mechanism is in the closed state, gas lift valve 100 restricts, blocks, and/or occludes fluid flow between the annular space and the tubular conduit via the lift gas injection conduit.

Figure 4:
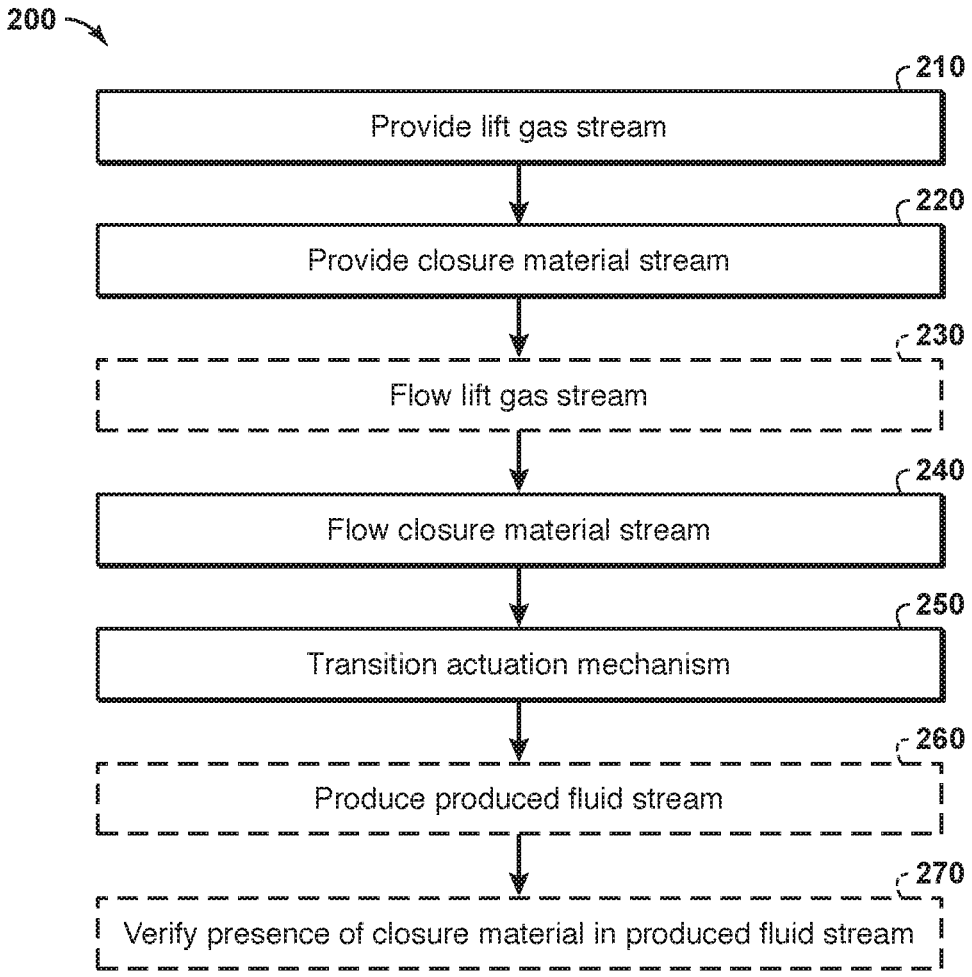
FIG. 4 is a flowchart depicting examples of methods of providing gas lift in a hydrocarbon well, according to the present disclosure.

During operation of hydrocarbon wells 28 according to the present disclosure, and as illustrated in FIG. 1 and discussed in more detail herein with reference to methods 200 of FIG. 4, lift gas supply system 50 may provide lift gas stream 52 to annular space 32 and may flow in a downhole direction 34 within the annular space, may flow into tubular conduit via one or more gas lift valves 100, and/or may provide gas lift to the hydrocarbon well. When it is no longer desirable to permit fluid flow through a given gas lift valve 100, closure material supply system 60 may provide closure material stream 62 to the annular space. Closure material stream 62 may be entrained within lift gas stream 52 and/or the flow of the lift gas stream within the annular space and may provide a motive force for flow of closure material 64 to the given gas lift valve 100. Responsive to contact with closure material 64, actuation mechanism 120 is configured to transition from the open state to the closed state, thereby restricting, blocking, and/or occluding fluid flow through lift gas injection conduit 110.

As discussed in more detail herein, the transition of actuation mechanism 120 from the open state to the closed state may be responsive to any suitable contact with closure material 64, examples of which include physical contact, fluid contact, and/or chemical contact. As also discussed in more detail herein, the transition of the actuation mechanism from the open state to the closed state may be based upon and/or may utilize any suitable transition mechanism, examples of which include physical, mechanical, chemical, chemical reaction, dissolution, solvation, agglomeration, and/or occlusion.

Hydrocarbon wells 28 including gas lift valves 100, according to the present disclosure, may provide one or more benefits over conventional hydrocarbon wells that may include and/or utilize conventional gas lift valves. As an example, gas lift valves 100 according to the present disclosure may avoid, or may not suffer from, leakage and/or calibration issues that may be common with conventional gas lift valves.

As another example, conventional gas lift valves operate via a pressure differential thereacross. In conventional hydrocarbon wells that utilize a plurality of conventional gas lift valves, each conventional gas lift valve of the plurality of conventional gas lift valves generally is set to a different operating pressure range, such as to avoid opening two conventional gas lift valves at the same time. The pressure differential, and the different operating pressure ranges of the different conventional gas lift valves, create a pressure overhead and require that the lift gas stream be provided to the conventional hydrocarbon well at pressures that generally are greater than pressures needed for operation of hydrocarbon wells 28 including gas lift valves 100, according to the present disclosure. As such, facilities and/or energy costs may be reduced by utilizing hydrocarbon wells 28 including gas lift valves 100, according to the present disclosure.

As yet another example, gas lift valves 100, according to the present disclosure, may be mechanically simpler, or may include fewer components, when compared to conventional gas lift valves. As such, gas lift valves 100, according to the present disclosure, may be cheaper to manufacture and/or more reliable to operate when compared to conventional gas lift valves.

As another example, conventional gas lift valves only may be actuated via the pressure differential thereacross. As such, it may not be possible to selectively open and/or close conventional gas lift valves, at least not without performing costly and/or time consuming intervention operations. In contrast, gas lift valves 100, according to the present disclosure, may be selectively transitioned from the open state to the closed state simply via supply of the closure material to the annular space.

Lift gas supply system 50 may include any suitable structure that may be adapted, configured, designed, and/or constructed to provide, or to selectively provide, lift gas stream 52 to annular space 32. As an example, lift gas supply system 50 may include a lift gas source 56 configured to store, to contain, and/or to house the lift gas, or a volume of the lift gas. Lift gas source 56 additionally or alternatively may be configured to generate lift gas stream 52. As another example, lift gas supply system 50 may include a lift gas compressor 58 configured to pressurize the lift gas, such as to produce the lift gas stream, to generate the lift gas stream, and/or to provide a motive force for flow of the lift gas stream within the annular space. Examples of the lift gas include nitrogen, carbon dioxide, air, a hydrocarbon gas, and/or natural gas.

It is within the scope of the present disclosure that lift gas supply system 50 may provide the lift gas stream to annular space 32 at any suitable lift gas stream supply pressure. Examples of the lift gas stream supply pressure include pressures of at least 1 megapascal (MPa), at least 2 MPa, at least 3 MPa, at least 4 MPa, at least 5 MPa, at least 6 MPa, at least 8 MPa, at least 10 MPa, at least 15 MPa, at least 20 MPa, at least 25 MPa, at least 30 MPa, at least 35 MPa, at most 100 MPa, at most 80 MPa, at most 60 MPa, at most 40 MPa, at most 35 MPa, at most 30 MPa, at most 25 MPa, at most 20 MPa, at most 15 MPa, and/or at most 10 MPa.

Closure material supply system 60 may include any suitable structure that may be adapted, configured, designed, and/or constructed to provide, or to selectively provide, closure material stream 62 to annular space 32 and/or to pump the closure material into the annular space. As an example, closure material supply system 60 may include a closure material source 66, which also may be referred to herein as a closure material storage structure 66. Closure material source 66 may be configured to store, to contain, and/or to house closure material 64, or a volume of the closure material. Closure material source 66 additionally or alternatively may be configured to generate, or to produce, closure material stream 62. As another example, closure material supply system 60 may include a closure material pump 68 configured to produce, to generate, and/or to provide a motive force for flow of the closure material stream into the annular space.

Examples of closure material 64 include a hydrocarbon, a liquid hydrocarbon, oil, water, an acid, and/or particulate material. In some examples, closure material 64 may be selected and/or configured to have a density that is less than a density of water and greater than a density of the lift gas stream. In such a configuration, the closure material may float at a water-gas interface 36 within annular space 32 and/or may contact a given gas lift valve 100 when the water-gas interface reaches the given gas lift valve.

It is within the scope of the present disclosure that closure material 64 and/or actuation mechanism 120 may be designed, constructed, and/or selected such that the actuation mechanism quickly transitions from the open state to the closed state responsive to contact with the closure material. Additionally or alternatively, it is also within the scope of the present disclosure that the closure material and/or the actuation mechanism may be designed, constructed, and/or selected such that the actuation mechanism slowly transitions from the open state to the closed state and/or transitions from the open state to the closed state in stages, or steps, responsive to contact with the closure material. Examples of suitable transition times are disclosed herein with respect to transitioning at 250.

Downhole tubular 40 may include any suitable structure that may extend within wellbore 30, that may define tubular conduit 42, that may be operatively attached to gas lift valve 100, that may be at least partially defined by gas lift valve 100, and/or that may at least partially bound annular space 32. As an example, downhole tubular 40 may include production tubing. As another example, and as discussed, downhole tubular 40 may include mandrel 90, and gas lift valve 100 may be operatively attached to the mandrel. Examples of mandrel 90 include a conventional mandrel and/or a side pocket mandrel.

As yet another example, downhole tubular 40 may include and/or may be at least partially defined by bottom hole valve 80. In some examples, and as discussed, bottom hole valve 80 may include and/or be a gas lift valve 100 according to the present disclosure. In other examples, bottom hole valve 80 may include and/or be a conventional bottom hole valve that may be configured to remain in a corresponding open state regardless of, or subsequent to, contact with the closure material.

It is within the scope of the present disclosure that hydrocarbon well 28 may include any suitable number of gas lift valves 100, which may be spaced-apart along a length of downhole tubular 40. In some examples, hydrocarbon well 28 may include a plurality of gas lift valves 100. As more specific examples, hydrocarbon well 28 may include at least 2, at least 3, at least 4, at least 5, at least 6, at least 8, at least 10, at least 12, at least 14, at least 16, at least 18, at least 20, at most 30, at most 25, at most 20, at most 15, and/or at most 10 gas lift valves 100, which may be spaced-apart along the length of the downhole tubular.

Turning now to FIGS. 2-3, examples of gas lift valves 100 are illustrated. More specifically, FIG. 2 is a schematic illustration of examples of gas lift valve 100 in open state 122, according to the present disclosure, while FIG. 3 is a schematic illustration of examples of gas lift valve 100 in closed state 124, according to the present disclosure. As discussed, gas lift valves 100 include a lift gas injection conduit 110 and an actuation mechanism. As also discussed, lift gas injection conduit 110 may extend between and/or may be configured to facilitate fluid communication between annular space 32 and tubular conduit 42; and actuation mechanism 120 is configured to selectively transition from open state 122 of FIG. 2 and closed state 124 of FIG. 3 responsive to contact with a closure material.

Actuation mechanism 120 may include any suitable structure that may be adapted, configured, designed, and/or constructed to transition from the open state to the closed state responsive to contact with the closure material. As an example, and responsive to contact with the closure material, actuation mechanism 120 may be configured to generate a motive force that transitions the gas lift valve from the open state to the closed state. As another example, and responsive to contact with the closure material, actuation mechanism 120 may be configured to occlude lift gas injection conduit 110.

As yet another example, actuation mechanism 120 may include a closure structure 130. In this example, and responsive to contact with the closure material, the actuation mechanism may be configured to release the closure structure to permit the closure structure to occlude the lift gas injection conduit. Additionally or alternatively, the actuation mechanism may be configured to urge the closure structure from an open position 134, as illustrated in FIG. 2, to a closed position 136, as illustrated in FIG. 3. When in open position 134, closure structure 130 may permit fluid flow through lift gas injection conduit 110. In contrast, when in closed position 136, closure structure 130 may resist, restrict, block, and/or occlude fluid flow through the lift gas injection conduit.

In some examples, actuation mechanism 120 may include a swellable material 150. Swellable material 150, when present, may be configured to swell upon, or responsive to, contact with the closure material, and this swelling may restrict fluid flow through, or through at least a region of, the lift gas injection conduit. Examples of the region of the lift gas injection conduit include all of a transverse cross-section of the lift gas injection conduit, a portion of a length of the lift gas injection conduit, and/or an entirety of the length of the lift gas injection conduit.

This restriction of fluid flow may be accomplished in any suitable manner. As an example, an as illustrated in FIG. 2, swellable material 150 may line or otherwise be positioned within at least a portion of lift gas injection conduit 110. In this example, and as illustrated in FIG. 3, the swellable material may restrict fluid flow through the portion of the lift gas injection conduit responsive and/or subsequent to contact with the closure material. As another example, and as illustrated by the transition from FIG. 2 to FIG. 3, swelling of the swellable material may provide a motive force 132 that may urge closure structure 130, when present, from open position 134 to closed position 136, thereby occluding at least a region of the transverse cross-section of the lift gas injection conduit.

Examples of swellable material 150 include a swellable material, a water-swellable polymer, a hydrocarbon-swellable polymer, an oil-swellable polymer, an acid-swellable polymer, a polyacrylic acid sodium salt, a sodium polyacrylate, an ethylene maleic anhydride copolymer, a crosslinked carboxymethylcellulose, a polyvinyl alcohol copolymer, and/or a cross-linked polyethylene oxide. Additional and/or alternative examples of swellable material 150 include materials that may be configured to swell responsive to contact with oil, a hydrocarbon fluid, water, and/or an acid.

In some examples, actuation mechanism 120 may include a soluble material 160, which may be configured to dissolve and/or corrode responsive to contact with the closure material. In these examples, and upon dissolution of at least a threshold region of the soluble material, the actuation mechanism may be configured to urge closure structure 130 to transition from open position 134 of FIG. 2 to closed position 136 of FIG. 3 and/or to occlude at least the region of the transverse cross-section of the lift gas injection conduit.

In these examples, actuation mechanism 120 further may include a biasing structure 162. Biasing structure 162 may be configured to urge closure structure 130 toward and/or to closed position 136, such as to urge biasing structure 162 to occlude at least the region of the lift gas injection conduit. Stated another way, biasing structure 162 may provide motive force 132 that urges closure structure 130 toward closed position 136. Prior to contact with the closure material, soluble material 160 may resist motion of the closure structure toward and/or to the closed position, thereby retaining the closure structure in open position 134 of FIG. 2. However, subsequent to contact with the closure material and/or subsequent to dissolution of at least the threshold region of the soluble material, motive force 132 may transition the closure structure from open position 134 of FIG. 2 to closed position 136 of FIG. 3.

Examples of soluble material 160 include a soluble polymer, a water-soluble polymer, a hydrocarbon-soluble polymer, an oil-soluble polymer, and/or an acid-soluble polymer. Additional and/or alternative examples of soluble material 160 include materials that may be configured to dissolve and/or to corrode responsive to contact with oil, a hydrocarbon fluid, water, and/or an acid.

In some examples, actuation mechanism 120 may include a porous structure 170 that may include, define, and/or have a plurality of pores 172. In this example, closure material 64 may be configured to occlude pores 172 responsive to contact between the porous structure and the closure material, as illustrated in FIG. 3. Examples of porous structure 170 include a filter medium, a perforated sheet, and/or a screen.

In this example, pores 172 may have and/or define a pore size, or an average pore size, and the closure material may include and/or be a particulate material that defines a particulate size, or an average particulate size. The particulate size may be greater than the pore size such that the closure material physically occluded pores 172 responsive to contact therewith. Additionally or alternatively, the closure material may be configured to collect and/or to agglomerate on porous structure 170 and/or within pores 172 to occlude the pores. As examples, the closure material may adhere to the porous structure and/or may polymerize responsive to contact with, or while in contact with, the porous structure.

As illustrated in FIGS. 2-3, porous structure 170 may be positioned within lift gas injection conduit 110 such that occlusion of pores 172 transitions the lift gas valve from the open state to the closed state. Additionally or alternatively, occlusion of pores 172 may cause actuation mechanism 120 to urge closure structure 130 from open position 134 of FIG. 2 to closed position 136 of FIG. 3, such as may be accomplished via hydraulic actuation, a diaphragm, and/or a pressure differential.

In some examples, gas lift valve 100 and/or actuation mechanism 120 may be configured to permanently and/or to irreversibly transition from open state 122 of FIG. 2 to closed state 124 of FIG. 3 responsive to contact with closure material 64. State another way, gas lift valve 100 and/or actuation mechanism 120 thereof may be configured to remain in, or within, the closed state subsequent to transitioning to the closed state and/or subsequent to transitioning from the open state to the closed state.

In other examples, gas lift valve 100 and/or actuation mechanism 120 thereof may be configured to selectively and/or to reversibly transition between the open state and the closed state. This may include selectively and/or reversibly transitioning from the open state to the closed state and/or selectively and reversibly transitioning from the closed state to the open state.

Such selective and/or reversible transitioning between the open state and the closed state may be accomplished in any suitable manner. As an example, and as illustrated in FIG. 1, hydrocarbon well 28 may include a valve opening material supply system 70. Valve opening material supply system 70, when present, may be configured to provide a valve opening material stream 72 of valve opening material 74 to annular space 32, and actuation mechanism 120 may be configured to transition from the closed state to the open state responsive to, or upon, contact with the valve opening material. As an example, actuation mechanism 120 may include swellable material 150 that swells responsive to contact with an acid and that shrinks, or contracts, responsive to contact with a base. In this configuration, closure material 64 may include and/or be an acid, and valve opening material 74 may include and/or be a base.

In some examples, gas lift valves 100 and/or actuation mechanisms 120 thereof also may include a pressure-actuated closure structure 140. Pressure-actuated closure structure 140 may be configured to selectively permit and/or restrict fluid flow through lift gas injection conduit 110 based upon and/or responsive to a pressure differential across the lift gas injection conduit and/or between annular space 32 and tubular conduit 42. When gas lift valves 100 include pressure-actuated closure structure 140 and actuation mechanism 120 is in open state 122 of FIG. 2, pressure-actuated closure structure 140 may selectively regulate fluid flow through lift gas injection conduit 110 based, at least in part, on the pressure differential. However, when actuation mechanism 120 is in closed state 124 of FIG. 3, the actuation mechanism may resist fluid flow through the lift gas injection conduit regardless of the pressure differential and/or may cause the pressure-actuated closure structure to occlude fluid flow through the lift gas injection conduit regardless of the pressure differential. Stated another way, when actuation mechanism 120 is in the open state and pressure-actuated closure structure 140 selectively permits fluid flow through the lift gas injection conduit, the lift gas injection conduit may provide fluid communication between the annular space and the tubular conduit. However, when actuation mechanism 120 is in the closed state and/or when pressure-actuated closure structure 140 selectively restricts fluid flow through the lift gas injection conduit, the lift gas injection conduit may not provide fluid communication between the annular space and the tubular conduit.

As illustrated in dashed lines in FIGS. 2-3, gas lift valve 100 may include a check valve 180. Check valve 180, when present, may be configured to permit, or to selectively permit, fluid flow from annular space 32 into tubular conduit 42 via lift gas injection conduit 110. In addition, check valve 180 may be configured to resist, to restrict, and/or to occlude fluid flow from the tubular conduit to the annular space via the lift gas injection conduit. FIGS. 2-3 illustrate check valve 180 in dashed lines to indicate that the check valve optionally may be present. In contrast with conventional gas lift valves, which generally are required to include corresponding check valves, gas lift valves 100, according to the present disclosure, may include check valves 180 but are not required to include check valves 180 in all examples. Stated another way, it is within the scope of the present disclosure that gas lift valves 100 may not include check valves 180 and/or may be free of a check valve that regulates fluid flow within the lift gas injection conduit.

FIG. 4 is a flowchart depicting examples of methods 200 of providing gas lift in a hydrocarbon well, such as hydrocarbon well 28 of FIGS. 1-3, according to the present disclosure. Methods 200 include providing a lift gas stream at 210 and providing a closure material stream at 220. Methods 200 also may include flowing the lift gas stream at 230 and include flowing the closure material stream at 240 and transitioning an actuation mechanism at 250. Methods 200 further may include producing a produced fluid stream at 260 and/or verifying a presence of closure material within the produced fluid stream at 270.

Providing the lift gas stream at 210 may include providing the lift gas stream to an annular space. The lift gas stream may include a lift gas. The annular space may be defined between a downhole tubular and a wellbore of the hydrocarbon well. The downhole tubular may extend within the wellbore and define a tubular conduit. Examples of the lift gas stream and/or of the lift gas are disclosed herein with reference to lift gas stream 52 and/or lift gas 54, respectively, of FIG. 1. Examples of the wellbore, the downhole tubular, the tubular conduit, and/or the annular space are disclosed herein with reference to wellbore 30, downhole tubular 40, tubular conduit 42, and/or annular space 32, respectively, of FIG. 1.

The providing at 210 may be performed in any suitable manner and/or utilizing any suitable structure. As an example, the providing at 210 may be performed with, via, and/or utilizing lift gas supply system 50 of FIG. 1.

Providing the closure material stream at 220 may include providing the closure material stream to the annular space. The closure material stream may include a closure material. Examples of the closure material stream and/or of the closure material are disclosed herein with reference to closure material stream 62 and/or closure material 64, respectively, of FIG. 1.

The providing at 220 may be performed in any suitable manner and/or utilizing any suitable structure. As an example, the providing at 220 may be performed with, via, and/or utilizing closure material supply system 60 of FIG. 1.

Flowing the lift gas stream at 230 may include flowing the lift gas stream within the annular space and/or to a lift gas injection conduit of a gas lift valve that is positioned along a length of the downhole tubular. Additionally or alternatively, the flowing at 230 may include flowing the lift gas stream through the lift gas injection conduit, such as to provide gas lift to the hydrocarbon well and/or within the downhole tubular. Examples of the lift gas injection conduit and/or of the gas lift valve are disclosed herein with reference to lift gas injection conduit 110 and/or gas lift valve 100, respectively, of FIGS. 1-3.

The flowing at 230 may be accomplished in any suitable manner. As an example, the providing at 210 may include providing the lift gas stream at a lift gas stream supply pressure, and the lift gas stream supply pressure may provide a motive force for the flowing at 230. Examples of the lift gas stream supply pressure are disclosed herein.

Flowing the closure material stream at 240 may include flowing the closure material stream within the annular space and/or to the lift gas injection conduit. Additionally or alternatively, the flowing at 240 may include flowing the closure material stream into, at least partially through, and/or completely thorough the lift gas injection conduit.

The flowing at 240 may be accomplished in any suitable manner. As an example, the closure material stream may be entrained in and/or within the lift gas stream, which may provide a motive force for the flowing at 240. Stated another way, the flowing at 240 may be subsequent to the providing at 220 and/or responsive to the flowing at 230.

Transitioning the actuation mechanism at 250 may include transitioning an actuation mechanism of the gas lift valve from an open state to a closed state. In the open state, the gas lift valve permits fluid flow between the annular space and the tubular conduit via the lift gas injection conduit. In the closed state, the gas lift valve restricts fluid flow between the annular space and the tubular conduit via the lift gas injection conduit. This may include occlusion of fluid flow from the annular space to the tubular conduit and/or from the tubular conduit to the annular space. The transitioning at 250 may be responsive to the flowing at 240 and/or responsive to contact between the closure material and the actuation mechanism.

The transitioning at 250 may be accomplished in any suitable manner. As an example, the transitioning at 250 may include occluding at least a threshold region, or even an entirety, of a transverse cross-section of the lift gas injection conduit with the closure material. As another example, the transitioning at 250 may include occluding at least a threshold fraction, or even an entirety, of a length of the lift gas injection conduit with the closure material. As yet another example, the transitioning at 250 may include swelling a swellable material that is positioned within the lift gas injection conduit. This may include swelling to restrict, to block, and/or to occlude at least a threshold fraction, or even an entirety of the transverse cross-section and/or of the length of the lift gas injection conduit.

It is within the scope of the present disclosure that the transitioning at 250 may include transitioning within a predetermined transition timeframe. Examples of the predetermined transition timeframe include timeframes of at least 1 second, at least 5 seconds, at least 10 seconds, at least 30 seconds, at least 1 minute, at least 2 minutes, at least 5 minutes, at least 10 minutes, at least 20 minutes, at least 30 minutes, at least 45 minutes, at least 1 hour, at most 5 hours, at most 4 hours, at most 3 hours, at most 2 hours, at most 1 hour, at most 45 minutes, at most 30 minutes, at most 15 minutes, at most 10 minutes, at most 5 minutes, at most 2 minutes, and/or at most 1 minute.

In some examples, the transition timeframe purposefully may be selected to be fast, such as on the order of at most 5 minute, at most 1 minute, and/or at most 30 seconds. Such a fast transition timeframe may decrease leakage of the lift gas stream into the tubular conduit via the lift gas injection conduit.

In other examples, the transition timeframe purposefully may be selected to be slow, or slower, such as on the order of at least 1 minute, at least 5 minutes, at least 10 minutes, at least 20 minutes, and/or at least 30 minutes. Such a slow transition timeframe may provide time for the closure material to flow into the tubular conduit, thereby permitting and/or facilitating the verifying at 270, which is discussed in more detail herein.

Producing the produced fluid stream at 260 may include producing the produced fluid stream from the hydrocarbon well and/or via the tubular conduit. This may include flowing formation fluids, at least a portion of the lift gas stream, and/or at least a portion of the closure material stream within the tubular conduit, from the gas lift valve, and/or to and/or into the surface region. Examples of the formation fluids are disclosed herein with reference to hydrocarbon fluids 24 of FIG. 1.

Verifying the presence of closure material within the produced fluid stream at 270 may include utilizing any suitable detection and/or verification methodology to detect and/or determine the presence of at least the fraction of the closure material stream in and/or within the produced fluid stream that is produced from the hydrocarbon well. Such verification may indicate that the closure material stream successfully has reached the gas lift valve and/or successfully has flowed through the lift gas injection conduit. As such, detection of the closure material within the produced fluid stream may be utilized to indicate, such as to an operator of the hydrocarbon well, that the gas lift valve successfully has been transitioned from the open state to the closed state. This may be especially true if the closure material is detected within the produced fluid stream for a period of time, such as may be comparable and/or proportional to the transition timeframe, which is discussed herein with reference to the transitioning at 250, and subsequently is not detected within the produced fluid stream.

The hydrocarbon wells and methods disclosed herein have been discussed in the context of hydrocarbon wells and methods within which the gas lift stream and the closure material are provided to the annular space. In the discussed hydrocarbon wells and methods, flow between the annular space and the tubular conduit via the gas lift valve generally has been from the annular space to the tubular conduit.

It is within the scope of the present disclosure that the hydrocarbon wells and methods additionally or alternatively may be configured such that the gas lift stream and the closure material instead are provided to the tubular conduit. In these hydrocarbon wells and methods, flow between the annular space and the tubular conduit via the gas lift valve may be from the tubular conduit to the annular space. In these hydrocarbon wells, the produced fluid stream may be produced with, via, and/or from the annular space, the lift gas supply system may provide the lift gas stream to the tubular conduit, and/or the closure material supply system may provide the closure material to the tubular conduit. Gas lift valves utilized in these hydrocarbon wells and methods may include check valves that permit fluid flow from the tubular conduit to the annular space and restrict fluid flow from the annular space to the tubular conduit. These check valves may be positioned, along the lift gas injection conduit, between the tubular conduit and the actuation mechanism, or a remainder of the actuation mechanism.

With specific reference to methods 200, and in these hydrocarbon wells and/or methods, the providing at 210 may include providing the lift gas stream to the tubular conduit, and the providing at 220 may include providing the closure material stream to the tubular conduit. Additionally or alternatively, the flowing at 230 may include flowing the lift gas stream within the tubular conduit and/or to the lift gas injection conduit, and the flowing the closure material stream may include flowing the closure material stream within the tubular conduit and/or to the lift gas injection conduit. Additionally or alternatively, the producing at 260 may include producing the produced fluid stream from the hydrocarbon well via the annular space.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A hydrocarbon well, comprising:

a wellbore extending within a subsurface region;

a downhole tubular extending within the wellbore, wherein the downhole tubular defines a tubular conduit, and further wherein the wellbore and the downhole tubular define an annular space therebetween;

a lift gas supply system configured to provide a lift gas stream that includes lift gas to the annular space;

a gas lift valve operatively attached to the downhole tubular, wherein the gas lift valve includes:

(i) a lift gas injection conduit that extends between the annular space and the tubular conduit; and (ii) an actuation mechanism configured to selectively transition between an open state, in which the gas lift valve permits fluid flow between the annular space and the tubular conduit via the lift gas injection conduit, and a closed state, in which the gas lift valve restricts fluid flow between the annular space and the tubular conduit via the lift gas injection conduit;

a closure material supply system configured to provide a closure material stream that includes a closure material to the annular space; and a valve opening material supply system configured to provide a valve opening material stream that includes a valve opening material to the annular space;

wherein:

(i) flow of the lift gas stream within the annular space is configured to provide a motive force for flow of each of the closure material stream and the valve opening material stream to the gas lift valve; and (ii) the actuation mechanism is configured to selectively and reversibly transition from the open state to the closed state responsive to contact with the closure material and from the closed state to the open state responsive to contact with the valve opening material.

2. The hydrocarbon well of claim 1, wherein, responsive to contact with the closure material, the actuation mechanism is configured to generate a motive force that transitions the gas lift valve from the open state to the closed state.

3. The hydrocarbon well of claim 1, wherein, responsive to contact with the closure material, the actuation mechanism is configured to occlude the lift gas injection conduit.

4. The hydrocarbon well of claim 1, wherein the actuation mechanism includes a closure structure, and further wherein, responsive to contact with the closure material, the actuation mechanism is configured to at least one of:

(i) release the closure structure to permit the closure structure to occlude the lift gas injection conduit; or (ii) urge the closure structure from the open position.

5. The hydrocarbon well of claim 1, wherein the gas lift valve further includes a pressure-actuated closure structure configured to selectively permit fluid flow through the lift gas injection conduit based, at least in part, on a pressure differential between the annular space and the tubular conduit across the lift gas injection conduit.

6. The hydrocarbon well of claim 5, wherein, when the actuation mechanism is in the open state, the actuation mechanism permits the pressure-actuated closure structure to selectively regulate fluid flow through the lift gas injection conduit, and further wherein, when the actuation mechanism is in the closed state, the actuation mechanism restricts fluid flow through the lift gas injection conduit regardless of the pressure differential.

7. The hydrocarbon well of claim 6, wherein, when the actuation mechanism is in the closed state, the actuation mechanism at least one of:

(i) occludes fluid flow through the lift gas injection conduit; or (ii) causes the pressure-actuated closure structure to occlude fluid flow through the lift gas injection conduit.

8. The hydrocarbon well of claim 1, wherein the actuation mechanism includes a swellable material configured to:

swell responsive to contact with the closure material to restrict fluid flow through at least a region of the lift gas injection conduit; and shrink responsive to contact with the valve opening material to permit fluid flow through at least a region of the lift gas injection conduit.

9. The hydrocarbon well of claim 8, wherein the closure material includes an acid and the valve opening material includes a base.

10. The hydrocarbon well of claim 1, wherein the actuation mechanism includes a porous structure that defines a plurality of pores, and further wherein the closure material is configured to occlude the plurality of pores responsive to contact between the porous structure and the closure material.

11. The hydrocarbon well of claim 1, wherein the actuation mechanism is configured to selectively and reversibly transition between the open state and the closed state within a predetermined transition timeframe of at most 5 minutes.

12. The hydrocarbon well of claim 1, wherein the hydrocarbon well includes a plurality of gas lift valves spaced-apart along a length of the downhole tubular.

13. A method of providing gas lift in a hydrocarbon well, the method comprising:

providing a lift gas stream that includes lift gas to an annular space that is defined between a downhole tubular and a wellbore of the hydrocarbon well, wherein the downhole tubular extends within the wellbore and defines a tubular conduit;

providing a closure material stream that includes a closure material to the annular space;

flowing the closure material stream through a lift gas injection conduit of a gas lift valve that is positioned along a length of the downhole tubular;

responsive to the flowing the closure material stream through the lift gas injection conduit, transitioning an actuation mechanism of the gas lift valve from an open state, in which the gas lift valve permits fluid flow between the annular space and the tubular conduit via the lift gas injection conduit, to a closed state, in which the gas lift valve restricts fluid flow between the annular space and the tubular conduit via the lift gas injection conduit;

providing a valve opening material stream that includes a valve opening material to the annular space;

flowing the valve opening material stream through the lift gas injection conduit of the gas lift valve; and responsive to the flowing the valve opening material stream through the lift gas injection conduit, transitioning the actuation mechanism of the gas lift valve from the closed state to the open state.

14. The method of claim 13, wherein the transitioning from the open state to the closed state includes occluding at least a region of a transverse cross-section of the lift gas injection conduit with the closure material.

15. The method of claim 13, wherein the transitioning from the open state to the closed state includes swelling a swellable material that is positioned within the lift gas injection conduit, and wherein the transitioning from the closed state to the open state includes shrinking the swellable material.

16. The method of claim 13, wherein the transitioning includes transitioning within a predetermined transition timeframe of at most 5 minutes.

17. The method of claim 13, wherein the method further includes producing a produced fluid stream from the hydrocarbon well via the tubular conduit.

18. The method of claim 17, wherein, subsequent to the transitioning from the open state to the closed state, the method further includes verifying the presence of the closure material within the produced fluid stream; and wherein, subsequent to the transitioning from the closed state to the open state, the method further includes verifying the presence of the valve opening material within the produced fluid stream.

* * * * *